US006305052B1

(12) United States Patent
Sinclair

(10) Patent No.: US 6,305,052 B1
(45) Date of Patent: Oct. 23, 2001

(54) HANDLE WITH CONCAVE/CONVEX PROFILE

(75) Inventor: Barry Sinclair, Mexborough (GB)

(73) Assignee: Ultradent Products, Inc., South Jordan, UT (US)

( * ) Notice: Subject to any disclaimer, the term of this patent is extended or adjusted under 35 U.S.C. 154(b) by 0 days.

(21) Appl. No.: 09/581,330

(22) PCT Filed: Oct. 28, 1998

(86) PCT No.: PCT/GB98/03219

§ 371 Date: Aug. 23, 2000

§ 102(e) Date: Aug. 23, 2000

(87) PCT Pub. No.: WO99/30874

PCT Pub. Date: Jun. 24, 1999

(30) Foreign Application Priority Data

Dec. 12, 1997 (GB) ..... 9726294

(51) Int. Cl.[7] ..... B25G 1/10

(52) U.S. Cl. ..... 16/430; 16/114 R; 16/421

(58) Field of Search ..... 16/114 R, 430, 16/421; D8/300, 107, 101; D7/649; 30/340, 348; 15/167.1

(56) References Cited

U.S. PATENT DOCUMENTS

| | | |
|---|---|---|
| 2,520,355 | 8/1950 | Bell . |
| 5,791,055 | 8/1998 | Mangol . |

FOREIGN PATENT DOCUMENTS

| | | |
|---|---|---|
| 23 44 987 | 3/1975 | (DE) . |
| 0 062 270 | 10/1982 | (EP) . |
| 0 775 552 | 5/1997 | (EP) . |
| 2 311 243 | 9/1997 | (GB) . |
| 94 03052 | 2/1994 | (WO) . |
| 96 32230 | 10/1996 | (WO) . |
| 97 04927 | 2/1997 | (WO) . |
| 97 07706 | 3/1997 | (WO) . |

*Primary Examiner*—Anthony Knight
*Assistant Examiner*—Mark Williams
(74) *Attorney, Agent, or Firm*—Workman, Nydegger & Seeley

(57) ABSTRACT

A handle for or of a hand held device which has on a side thereof a concave convex profile to accommodate the pad and base (or heel) of the thumb, opposite which side the handle is sufficiently bulbous to provide a surface against which all of the first three fingers of the user engage. This anthropometric handle provides the user or holder thereof with improved feel and purchase.

5 Claims, 1 Drawing Sheet

HANDLE WITH CONCAVE/CONVEX PROFILE

BACKGROUND OF THE INVENTION

1. Field of the Invention

This invention relates to hand held devices, and specifically relates to handles for such devices, and devices including such devices, 2. Present State of the Art It is known to provide handles of tooth brushes with a certain degree of shaping to enable them to be comfortably and firmly held, but generally such candles are elongated rods, and do not provide the comfort and grip which might be expected, because when the fingers are wrapped round the rod handle, there is only limited contact between the rod and the fingers, and control and comfort are compromised.

BRIEF SUMMARY OF THE INVENTION

The present invention seeks to provide a handle of or for hand held devices, including toothbrushes, which is configured to provide enhanced comfort and firmness to the user.

According to the invention there is provided a handle for or of a hand held device, wherein the handle has on a side thereof a concave convex profile to accommodate the pad and base (or heel) of the thumb, opposite which side the handle is sufficiently bulbous to provide a surface against which all of the first three fingers of the user engage.

The handle is preferably moulded in plastics material, and can be used for or as part of any of a large variety of hand held devices, including tooth and other brushes, working tools such as screwdrivers, chisels, ratchet tools, and hand held articles in general.

BRIEF DESCRIPTION OF THE DRAWINGS

An embodiment of the invention will now be described by way of example with reference to the accompanying drawings, wherein.

DETAILED DESCRIPTION OF THE PREFERRED EMBODIMENTS

Figure 1:
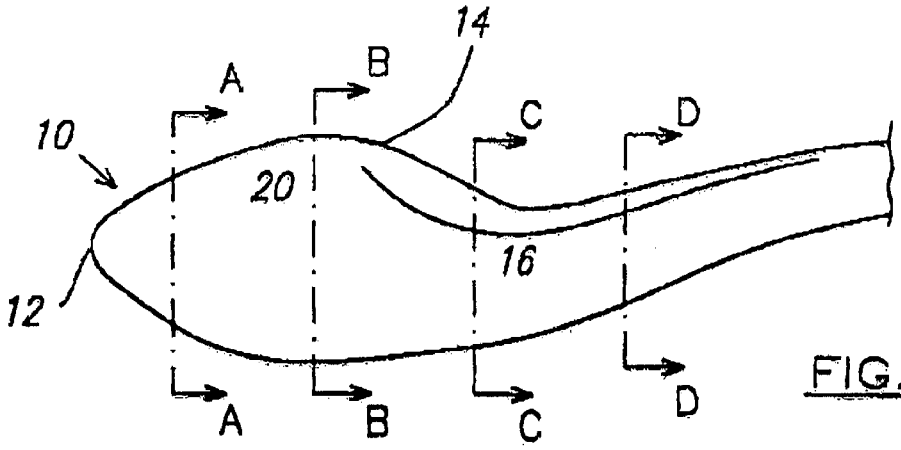
FIG. 1 is a side view of the handle of the present invention.
Figure 2:
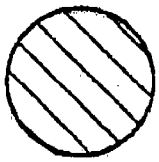
FIGS. 2, 3, 4 and 5 are sectional views taken along the lines A—A, B—B, C—C and D—D, respectively.
Figure 3:
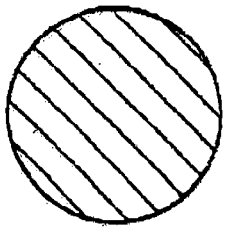
Figure 4:
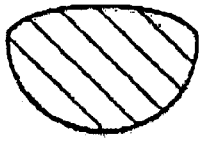
Figure 5:
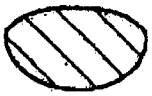

Referring to the drawings, the handle is shown in FIG. 1, and is indicated by the numeral 10. It is a solid body formed typically of plastics by moulding and, it has a varying cross sectional shape as shown in FIGS. 2 to 5. Proceeding from the left hand end in FIG. 1 and referring to FIGS. 2 to 5 from a nose 12, the body has a circular cross section at sections A—A and B—B, and until the region 14 where at the top side of the handle, the profile enters a concave region 16. Sections C—C and D—D show how this concave profile affects the shape of the handle.

The top side of the handle 10 has a concave (region 16) convex (region 20) profile at the top side thereof, and the remainder of the handle is bulbous, in this example of circular cross section. This concave convex profile matches the inner profile of the thumb and therefore this side of the handle is an anthropometric match for the thumb. Thus as shown in FIG. 6, the handle seats in a comfortable and firm fashion against the thumb when the handle is positioned in the user's hand.

Figure 6:
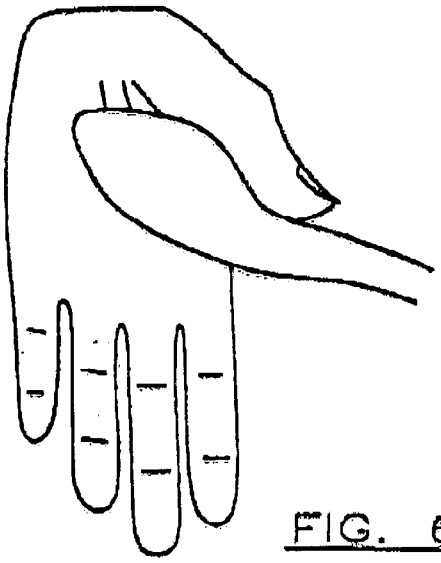
FIG. 6 is a perspective view of the handle of FIG. 1 when positioned in a hand, but before the fingers have moved to the holding position.
Figure 7:
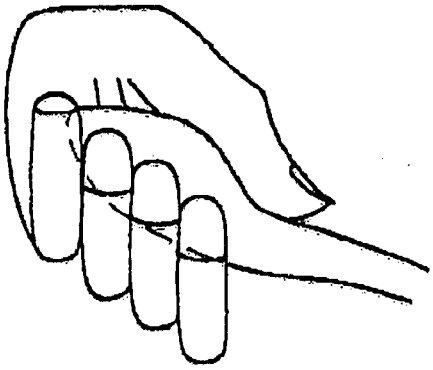
FIG. 7 is a view similar to FIG. 6, but showing the fingers clasped around the handle.

FIG. 6 shows the handle positioned before the fingers are clasped around it, and FIG. 7 shows the handle when fully grasped. It can be seen from FIG. 7 that the handle is sufficiently bulbous that all of the first three fingers grasp the handle, enhancing the grip and comfort of the handle.

The handle is symmetric about a longitudinal axis and therefore can be used equally in the right or left hand.

What is claimed is:

1. A handle for a hand held device and which is adapted for improved feel and purchase when held in the palm of a hand and between a thumb and fingers, the handle comprising:

a top side having a portion thereof which is formed into a combination concave convex profile in which, a first portion of the top side of the handle comprises a convex region which is bulbous and slopes from the center portion of the convex region in a tapered fashion toward the rear end of the handle, the convex portion also sloping and tapering down toward the front end of the handle so as to converge into a concave, indented region on said top side which is thereby formed to receive the inner profile of the thumb in a manner which constitutes an anthropometric match for the inner profile of the thumb, and a bottom side which is continuously convex and which slopes and tapers upwardly toward the rear of the hand from the center portion of the convex region to terminate in a bulbous end portion which fits within the palm of the hand and is sufficiently bulbous to provide a surface against which the first three fingers of the user may engage.

2. A handle according to claim 1 wherein the handle is molded in plastics material.

3. A handle as recited in claim 1, wherein said bulbous end portion has a transverse cross section that is substantially circular at a plurality of longitudinally spaced apart locations.

4. A handle as recited in claim 1, wherein at least a section of a forwardly extending portion of the handle has a transverse cross section that is substantially elliptical.

5. A handle as recited in claim 4, wherein at least part of the top side of said forwardly extending portion is substantially flat along the length thereof.

* * * * *

UNITED STATES PATENT AND TRADEMARK OFFICE

CERTIFICATE OF CORRECTION

PATENT NO. : 6,305,052 B1
DATED : October 23, 2001
INVENTOR(S) : Barry Sinclair

It is certified that error appears in the above-identified patent and that said Letters Patent is hereby corrected as shown below:

Title page,

Item [56], References Cited, US PATENT DOCUMENTS please add

| | | | |
|---|---|---|---|
| -- | DES 285,835 | 9/1986 | Hanses -- |
| -- | DES 383,612 | 9/1997 | Chan -- |
| -- | DES 422,413 | 9/1997 | Goldinger et al. -- |
| -- | 4,283,808 | 8/1981 | Beebe -- |
| -- | 4,429,434 | 2/1984 | Sung-shan -- |
| -- | 4,780,924 | 11/1988 | Hansen et al. -- |
| -- | 5,740,586 | 4/1998 | Gomas -- |
| -- | 5,761,767 | 6/1998 | Barton -- |
| -- | 5,965,009 | 10/1999 | Hoepfl et al. -- |

FOREIGN PATENT DOCUMENTS, please insert

| | | | |
|---|---|---|---|
| -- | 94 04322 | 3/1994 | (WO) -- |

Signed and Sealed this

Thirtieth Day of July, 2002

*Attest:*

*Attesting Officer*

JAMES E. ROGAN
*Director of the United States Patent and Trademark Office*